United States Patent [19]

Brulfert

[11] 3,952,707

[45] Apr. 27, 1976

[54] HOT-FLUID GENERATOR USING CATALYTIC COMBUSTION

[76] Inventor: André Brulfert, 6 rue des Peintres Parrocel, Avignon, France

[22] Filed: Dec. 18, 1974

[21] Appl. No.: 533,811

[52] U.S. Cl. ..... 122/367 R; 122/4 D; 122/156; 431/326

[51] Int. Cl.[2] ..... F22B 7/00

[58] Field of Search ..... 122/4, 156, 250 R, 367 R; 431/326, 328, 329, 7

[56] References Cited

UNITED STATES PATENTS

| | | | |
|---|---|---|---|
| 1,213,470 | 1/1917 | Finlay | 431/7 |
| 2,551,823 | 5/1951 | Buttner et al. | 122/4 |
| 3,315,646 | 4/1967 | Witten, Jr. | 431/329 X |
| 3,759,244 | 9/1973 | Konet | 431/328 |
| 3,807,366 | 4/1974 | Murtland, Jr. | 431/326 |
| 3,842,807 | 10/1974 | Sittek et al. | 431/326 X |

*Primary Examiner*—Kenneth W. Sprague
*Attorney, Agent, or Firm*—Karl F. Ross; Herbert Dubno

[57] ABSTRACT

A hot-fluid generator, e.g. for heating water or producing steam, which comprises at least two vertical spaced-apart catalyst elements for the combustion of a hydrocarbon fuel to generate heat, a thin hollow vertical panel of heat-conductive material interposed between and substantially coextensive with the broad catalyst surfaces of the elements and a supply pipe below the panel and a distribution pipe above the panel for respectively supplying fluid to and removing it from the panel. When the catalyst elements are coaxial cylinders, the thin hollow panel or vessel is also a cylinder coaxial with the catalyst elements. Where the catalyst elements are generally planar, a dome-shaped vessel can communicate with the panel and be provided with passages for the exhaust gases. Transfer vessels can be provided along opposite vertical edges of the main vessel or panel and the vessels can be provided with horizontally extending fins projecting into the space between the catalyst elements.

13 Claims, 6 Drawing Figures

HOT-FLUID GENERATOR USING CATALYTIC COMBUSTION

This application relates to copending application Ser. No. 402,576 filed October 1, 1973, now U.S Pat. No. 3,908,602.

The present invention relates to a steam or hot-water generator on the basis of the catalytic combustion of hydrocarbons, using catalyst elements and a suitable fuel for producing the heat.

Such a steam or hot-water generator is already known, and in this the catalyst elements are arranged vertically, preferably as a battery, inside a heat-insulated casing, with the space between the elements being occupied by a piping system through which the liquid to be vaporized or heated flows from the bottom to the top. In a special embodiment, this piping system consists of sets of vertical tubes between a lower supply pipe and an upper collecting pipe.

In steam or hot-water generators of this kind, the important thing is to prevent the catalytic panels from radiating directly on each other, in order to obtain better efficiency. The idea has already been put forward of connecting the tubes of the same set together by fins or some other suitable method, so as to form a screening partition, without any gaps, between the catalytic panels. This screening partition prevents the direct radiation from one panel on others.

The object of the present invention is to provide a different method of construction which likewise prevents this direct radiation and which, in addition, ensures optimum performance of the steam or hot water generator.

To this end, according to the invention, the space between the catalyst elements, which are arranged facing each other, is occupied by at least one thin vertical vessel which joins the bottom and the top of the generator and communicates, with at least one bottom supply pipe and with at least one top collecting pipe, so as to create a continuous sheet of the liquid to be vaporized or heated.

This vertical vessel, containing a continuous sheet of liquid, has a thickness which is small in relation to its other dimensions is chosen to suit the thermal output of the catalysts. It can be fitted between the parallel catalyst elements, which themselves are housed inside a heat-insulated casing of square, rectangular, polygonal or circular horizontal cross section.

In order to make the best use of the calorific radiation from the catalyst panels, when these panels are all parallel to the same vertical plane, the end walls of the generator are, with advantage, formed by thin vertical vessels at right angles to the vessels fitted between the catalyst elements, fed by a bottom supply pipe or by communicating with ends of the vessels fitted between the catalyst elements, and communicating with the top collector pipe.

According to another feature of the invention, the top of the generator is likewise formed by at least one thin vessel fitted above the catalyst elements and containing liquid to be vaporized or heated. This vessel can communicate, directly or otherwise, with the tops of the other vessels containing the sheets of liquid, in such a way as to take part in the general liquid paper circuit producing steam or hot water. It can also form an independent unit for producing steam or hot water, suitable for supplying, for example, a hot water network for a medical installation.

This top vessel has, for example, the shape of a semi-cylindrical dome or something similar so as to form a collecting surface for the fumes and the heat stored in them. In that case the exhaust pipes for the fumes pass through it, and it has baffle plates fitted near the place where the exhaust pipes emerge.

It is an advantage if, above the aforesaid top vessel, there is provided a second vessel of smaller capacity, connected either to the said top vessel or directly to the vessels which are fitted between the catalyst elements. This is desirable where the first top vessel forms an independent heating unit.

Preferably, through this second top vessel there also passes at least one pipe traversed by the fumes which were collected by the first, dome-shaped, top vessel. This pipe makes recovery possible from the fumes after they have passed through the first top vessel and have already given up the greater part of their heat.

The various vessels containing the continuous sheets of the liquid to be vaporized or heated preferably have fins on their surfaces subjected to the calorific radiation from the catalyst elements and/or on their surfaces in contact with the fumes, these fins being intended to increase the heat-exchange area and to slow down the fumes.

The generator of the invention can also have other vessels containing a sheet of the liquid to be vaporized or heated, these being fitted on the outside so as to collect by conduction part of the heat produced by the catalyst elements; these external vessels communicate with a bottom supply pipe and with the top vessel or vessels.

The invention will be better understood with the help of the following description, reference being made to the attached schematic drawing showing several embodiments of the steam or hot-water generator according to the invention.

Figure 1:
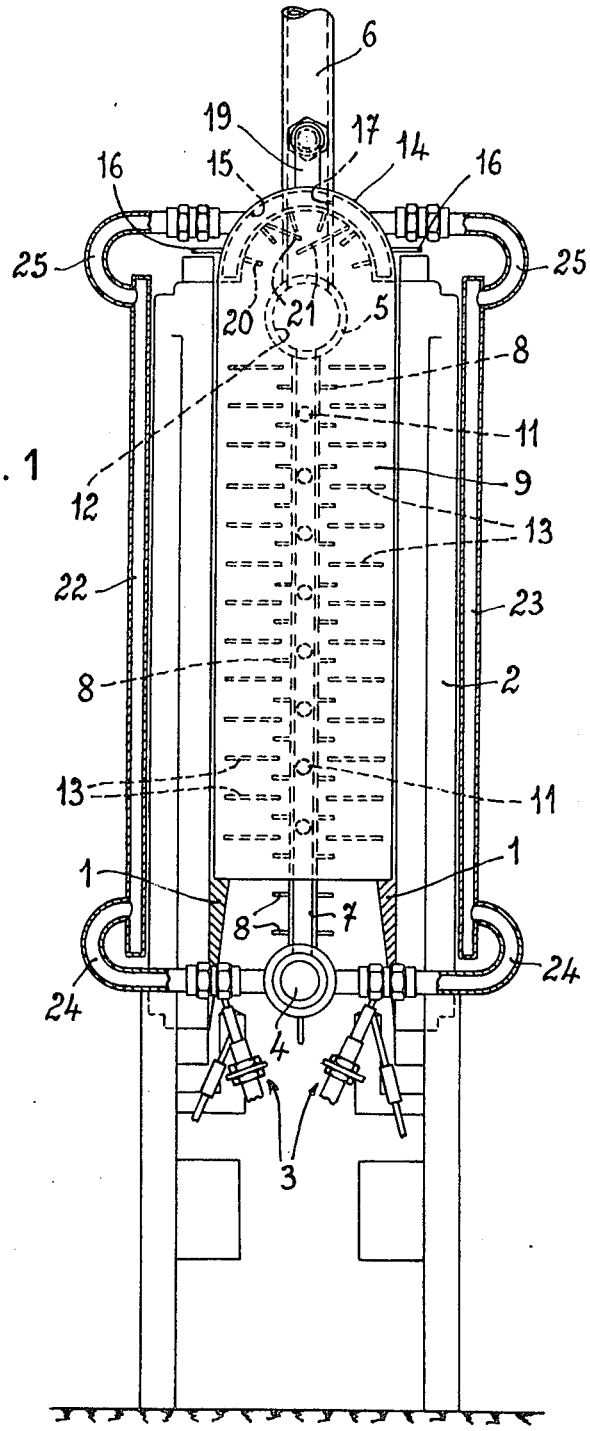
FIG. 1 is an end view, partly in section, of a first embodiment, of a fluid heater with an elongated rectangular shape.

The steam or hot-water generator according to the invention has catalyst elements 1 in the form of panels fitted vertically inside a heat-insulated casing 2. These panels 1 are arranged in a battery, with pairs of panels each other; in the example shown in FIGS. 1 to 3 the number of panels is limited to two.

These catalyst panels 1, on the basis of pletinum sponge, cobalt sponge, ferronickel sponge, or any other material capable of acting as a catalyst for the oxidation and combustion of hydrocarbons, are supplied with fuel by an arrangement 3, situated at the base of each of them, and having among other things a conventional system of ignition.

The liquid to be vapourised or heated is brought to the base of the generator by a supply pipe 4, and it leaves via a top collector pipe 5 joined to a distribution pipe 6. Between the supply pipe 4 and the collector pipe 5 the liquid follows a rising trajectory between the catalyst panels 1, this general arrangement being already known in itself.

In accordance with the present invention, the space between the two catalyst panels 1 in FIG. 1 is occupied by a thin vertical vessel 7, fitted in the median plane of the generator and joining its two ends. This vessel 7 communicates by its bottom part with the supply pipe 4, and by its top part with the top collector pipe 5.

The two faces of the vessel 7 which are subjected to the radiation from the catalyst panels 1 are provided with horizontal fins 8, either fastened on or made during the casting of the vessel.

The end walls of the generator, situated at the ends of the vessel 7, consist of two similar thin vessels 9 and 10, at right angles to the vessel 7 and extending between the two panels 1 and over almost all the height of these panels. These end vessels 9 and 10 communicate with the ends of the vessel 7 by means of openings 11. In addition, the ends of the top collector pipe 5 open into the vessels 9 and 10 at the openings 12.

On their surfaces facing the inside, and subject to the calorific radiation, the vessels 9 and 10 have short horizontal fins 13 situated halfway between the fins 8 on the central vessel 7.

The top of the generator is likewise formed by a thin vessel 14, which is situated above the catalyst panels 1 and the central vessel 7. The top vessel 14 has the curved shape of a semi-cylindrical dome. It joins together the tops of the two end vessels 9 and 10 and communicates with these latter vessels by the apertures 15.

On its sides the top vessel 14 has fixing lugs 16 enabling it to be firmly fastened to the main casing 2 which supports the catalyst panels 1. The top of the vessel 14 also has three through holes, i.e. a central hole 17 through which passes the distribution pipe 6, and two side holes 18, arranged at either side of the hole 17, through which pass the exhaust pipes for the fumes; the exhaust pipes have not been shown in the drawing.

Two pipes 19 lead from the top vessel 14 and are joined, outside the generator, to the distribution pipe 6.

The lower surface of the top vessel 14, which is in contact with the rising fumes, has longitudinal fins 20. It also supports, near the openings of the holes 18, provided as plates 21 which form baffles.

Other vessels 22 and 23, fitted outside the principal casing 2 and parallel to the plane of the central vessel 7, likewise take part in the circulation of the liquid and in the reception of the heat. The vessels 22 and 23 are supplied at their bases by pipes 24 coming from the supply pipe 4, and at their top end they communicate with the top vessel 14 by other pipes 25. The sake of clarity in the drawing the pipes 24 and 25 have been shown only in FIG. 1.

When the generator is in operation, the liquid brought in by the bottom pipe 4 splits up into the various vessels 7, 9, 10, 14, 22 and 23, in the form of continuous sheets. The fins 8, 13 and 20 enable the heat-exchange area to be increased, and the fumes to be slowed down, and there can likewise be provided, inside the various vessels, baffles for slowing down the circulation of the liquid. Because of its shape the top vessel 14 can play the part of a collector for the fumes and for the heat stored in them. The baffle plates 21 which it carries contribute towards the slowing down of the exhaust of the fumes. The external vessels 22 and 23, arranged behind the catalyst panels 1, collect the heat transmitted towards the outside by conduction.

The generator has excellent performance by avoiding to the maximum extent any heat losses.

Other accessories can be provided according to the use to which the generator is to be put. Thus, in particular, hot plates can be fitted over the top vessel 14, so that this generator can serve additionally as an auxiliary cooking arrangement. In this case the hot plates can be provided with hinged lift-up insulating covers.

Figure 2:
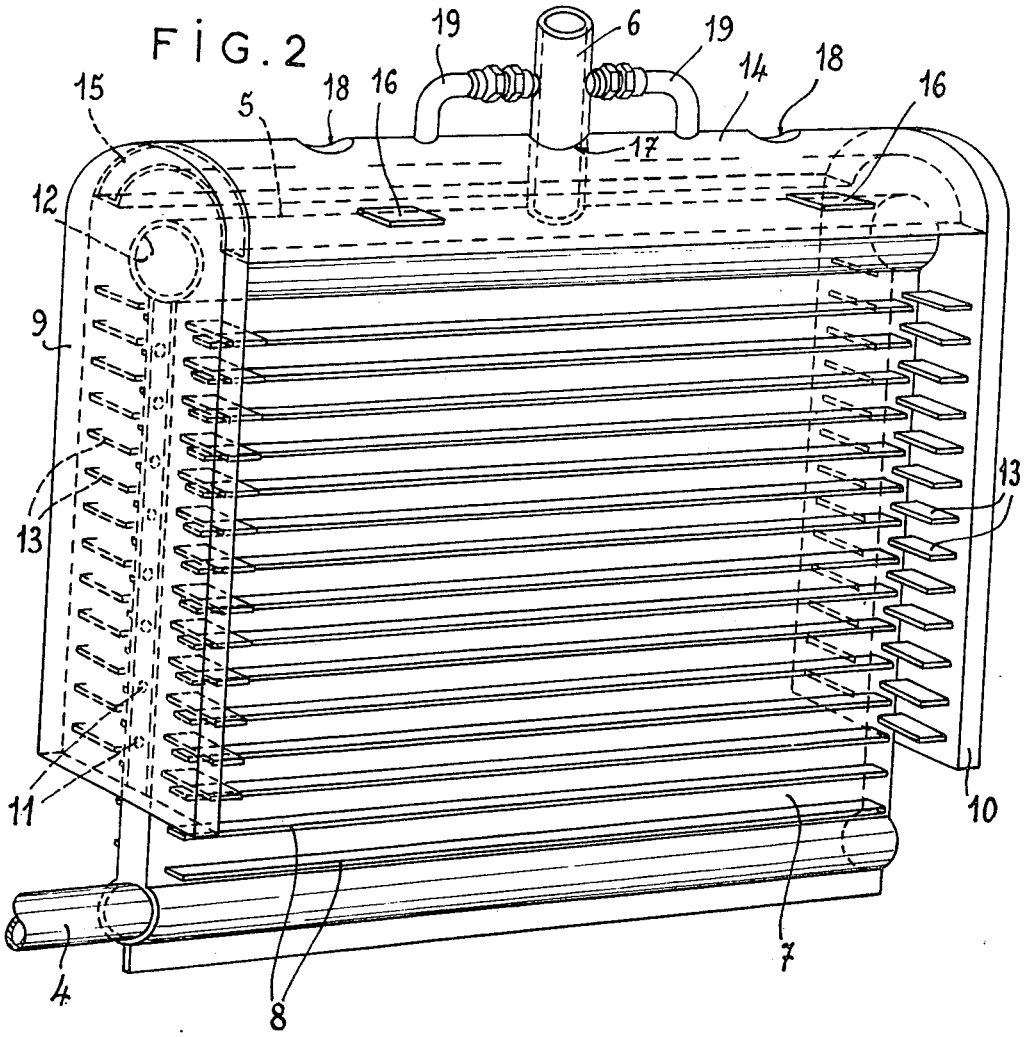
FIG. 2 is a perspective view showing the internal construction of the generator of FIG. 1.
Figure 3:
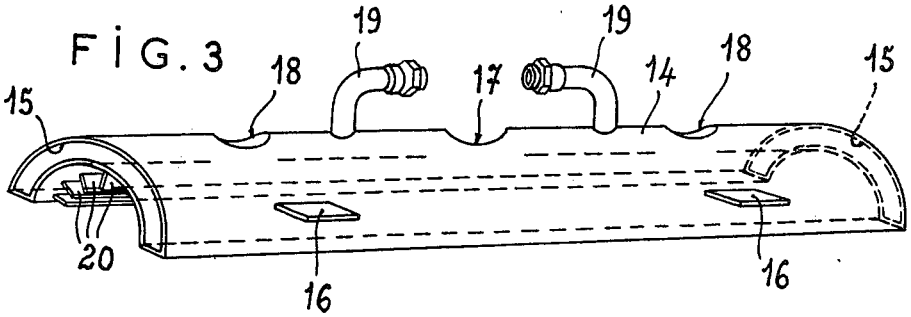
FIG. 3 is a view of part of the generator, showing in perspective the semi-cylindrical dome of this generator.
Figure 4:
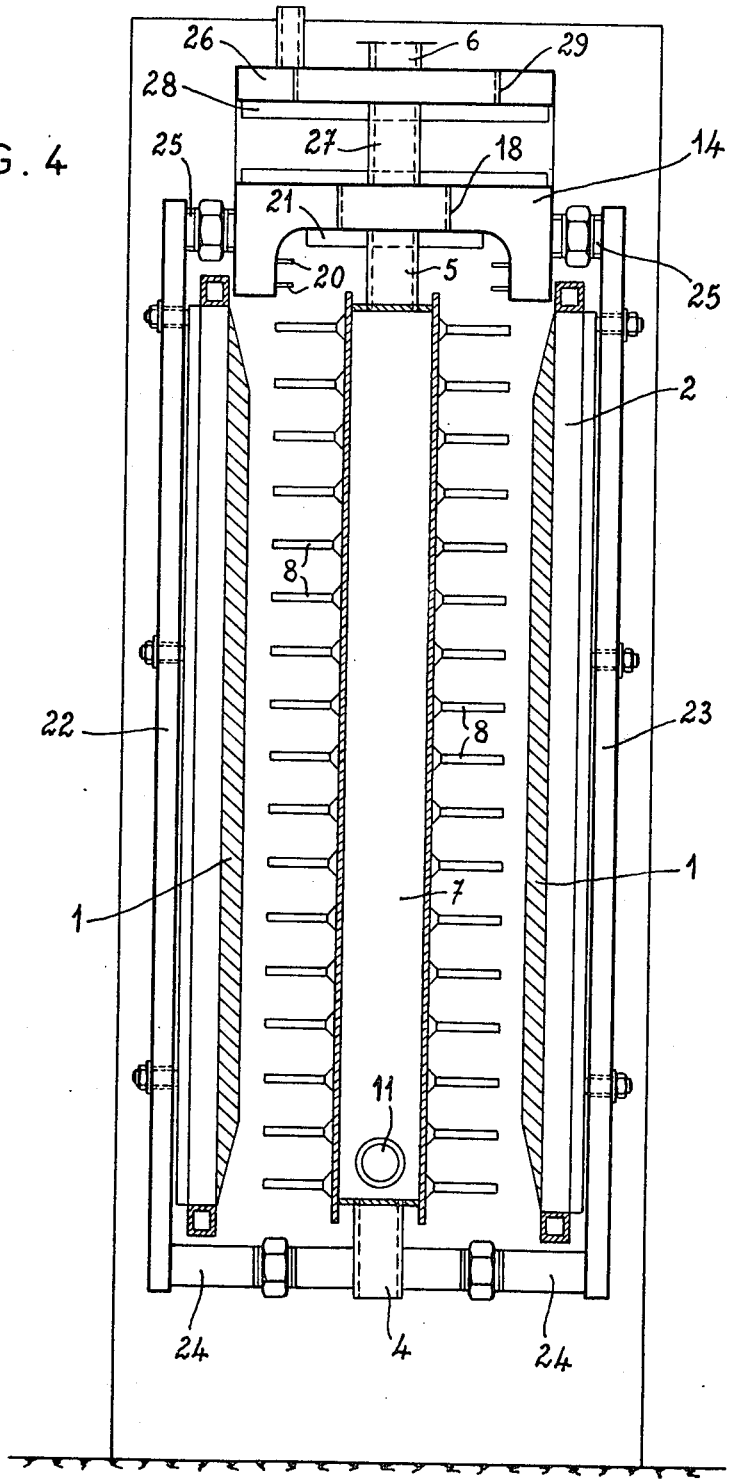
FIG. 4 is a view in transverse section, illustrating an alternative construction of the generator in FIGS. 1 to 3.

FIG. 4 represents an alternative to the embodiment of FIGS. 1 to 3 and differing little therefrom except at the top part, where another flat vessel 26 is fitted above the vessel 14 and communicates with the latter top vessel 14 by vertical pipes 27. The vessel 26 also has fins 28 arranged transversely on its bottom surface, as well as through-holes 29 through which are brought the exhaust pipes for the fumes, which have already passed through the holes 18 in the vessel 14.

In another alternative, which has not been represented, the end vessels 9 and 10, in the same way as the external vessels 22 and 23, are arranged behind catalyst panels which are at right angles to the longitudinal catalyst panels 1. These auxiliary panels enable the total surface area of the catalyst elements to be enlarged, and thus increase the production of heat.

Figure 5:
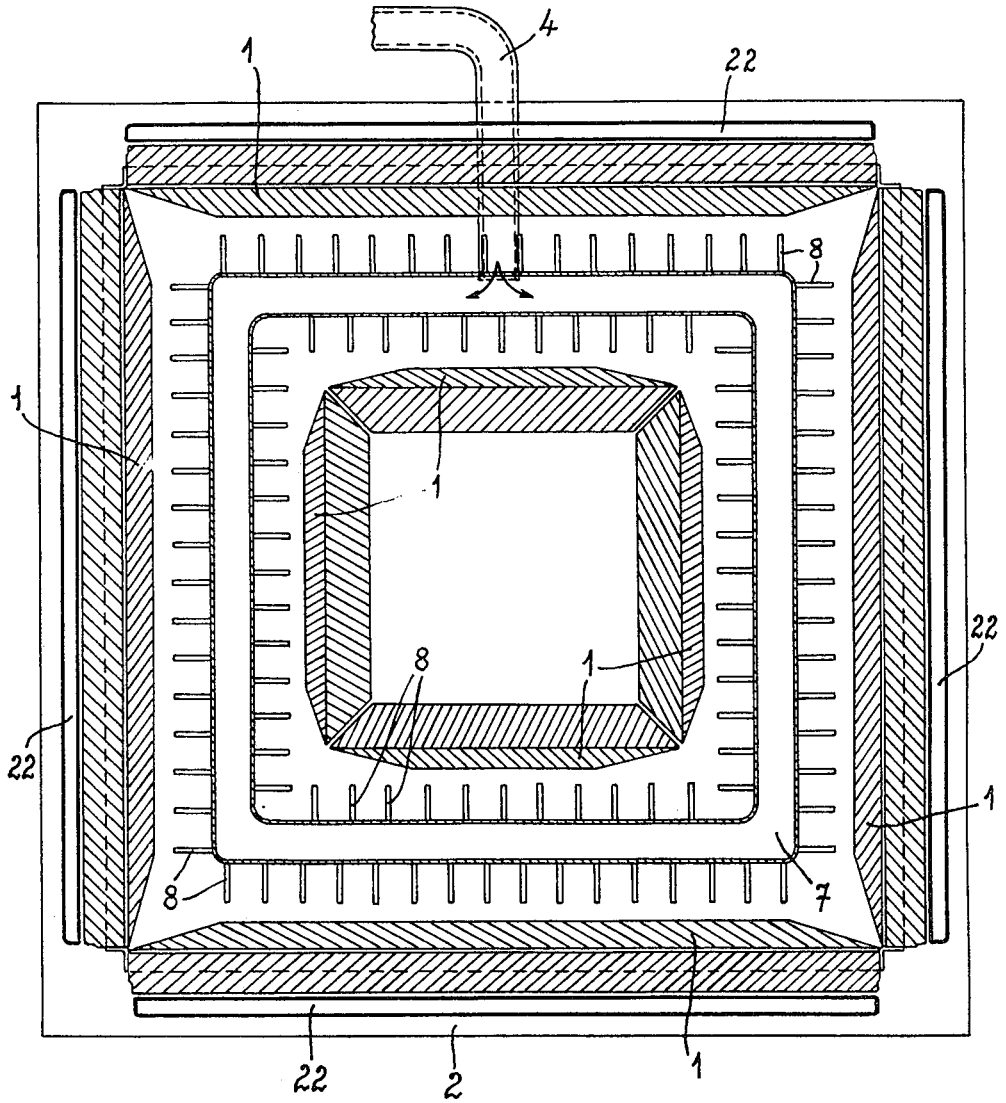
FIG. 5 is a view in horizontal section of another embodiment, with a square horizontal cross-section.

FIG. 5 is a view in horizontal section, taken at about half the height, of a generator which has a square horizontal cross-section and which has, inside the casing 2, two sets of catalyst panels 1 mounted in a square, the set of the smaller panels being housed inside the set of larger panels. Between these two sets of panels 1 there is a central vessel 7, likewise of square horizontal cross-section, which is supplied by a pipe 4 connected to one of its sides. Other pipes supply a set of vessels 22, arranged in a square, at the back of the outer catalyst elements 1. The top part of the generator is constructed in a similar manner to what has already been described above in connection with FIGS. 1 to 4, the only notable difference being that the top vessel or vessels, instead of being elongated, are also square.

Figure 6:
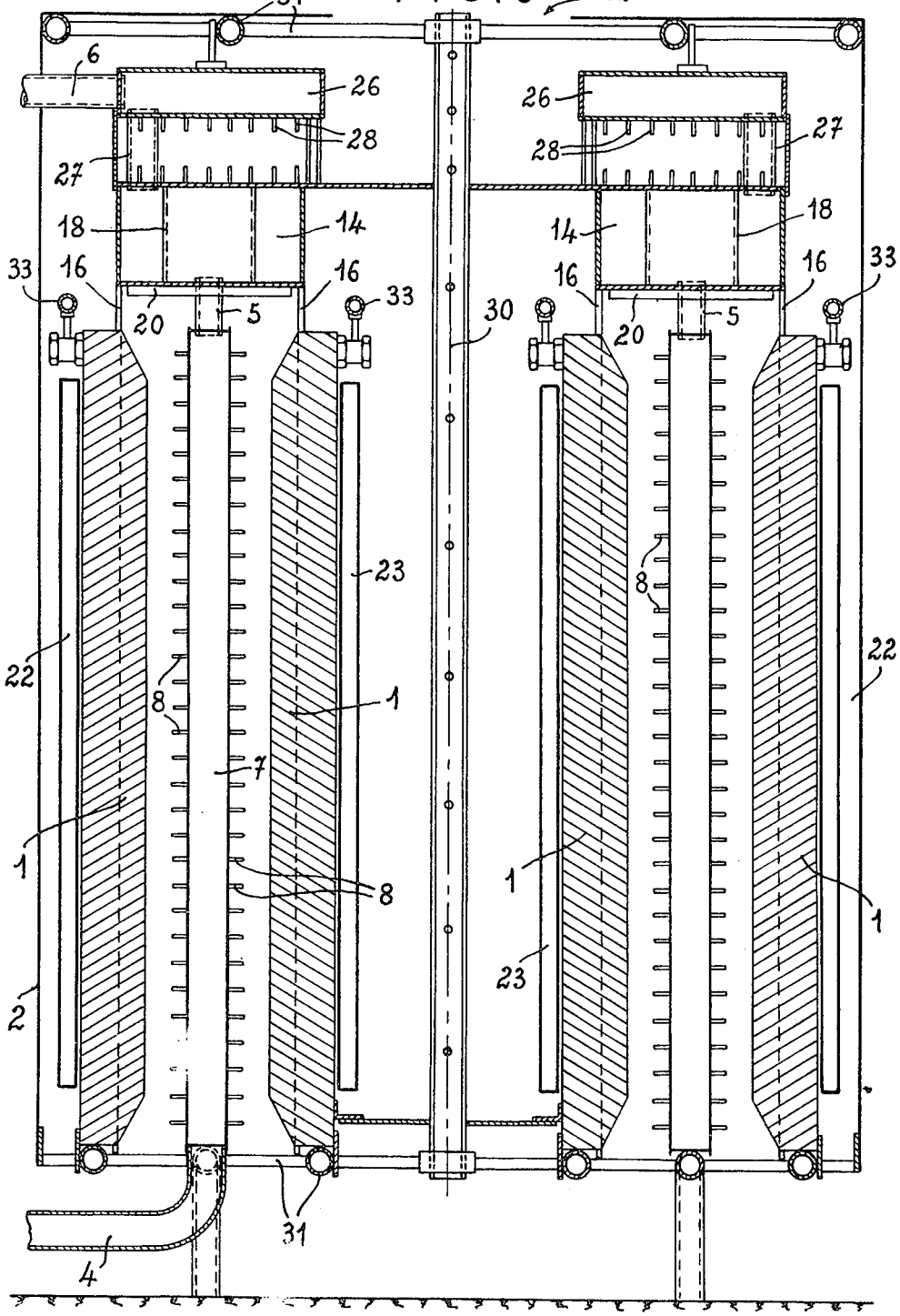
FIG. 6 is a view in vertical section through the axis of a cylindrical embodiment.

FIG. 6 is a view in vertical section, through the axis, of a generator according to the invention in which all the important parts have a cylindrical shape. Starting from the vertical axis 30, which is common to all these cylindrical parts, one finds successively: and interior cylindrical vessel 23; a first cylindrical catalyst panel 1, at the back of which is placed the vessel 23; an annular central space in the middle of which is arranged a cylindrical central vessel 7; a second cylindrical catalyst panel 1; an external cylindrical vessel 22, situated at the back of the second catalyst panel. All the aforesaid components are supported by a tubular framework 31. The vessels 7, 22 and 23 communicate with a bottom supply pipe 4 and with top collector pipes 5 which lead into a top vessel 14 of annular shape, over which is placed a second annular top vessel 26 of smaller capacity, the arrangement being analogous to that of FIG. 4 and not needing to be described again. It should be noted that in this case the discharge of the fumes takes place through a central passage 32, and that the gas supply piping 33 is, in this case, situated at the top of the catalysts 1.

In FIGS. 4 and 6, the two top vessels 14 and 26 form part of the same general circuit for producing steam or hot water. However, as an alternative, provision can be made for one of these vessels, for example the vessel 14, to form an independent unit for producing steam or hot water, this unit being associated with an auxiliary circuit.

As is obvious, the invention is not restricted only to the forms of construction of this steam or hot-water generator which have been described above. On the contrary, it covers all alternative ways in which it can be carried out. Thus, in particular, the shape of the generator can be modified; its horizontal cross-section may be not only rectangular, square or circular, but can also be some other polygon. Likewise, the number of catalyst panels, and consequently the number of vertical vessels fitted between the catalyst elements which face each other, this number being very limited in the examples described, can be made greater, according to the throughput or heat output desired, without departing from the spirit of the invention.

I claim:

1. A hot-fluid generator comprising:

at least two vertical catalyst elements having spacedly juxtaposed broad surfaces for the combustion of a hydrocarbon fuel to generate heat;

a thin hollow vertical panel forming a main vessel and composed of continuous heat-conductive walls interposed between and substantially coextensive with said surfaces;

a supply pipe below said vessel and communicating therewith for supplying a fluid to said vessel at the bottom thereof; and a dome-shaped vessel lying above said main vessel and communicating therewith while overlying the space between said catalyst elements, said dome-shaped vessel having a downwardly concave wall formed with inwardly projecting fins, and a distribution pipe above said vessel and communicating therewith for withdrawing heated fluid from said vessel, said fluid passing in a continuous sheet through said main vessel between said elements.

2. The generator defined in claim 1 which is a horizontal rectangular cross section with said panel and said elements being planar and parallel to the same vertical plane.

3. The generator defined in claim 1 which has a cylindrical horizontal cross section, said catalyst elements being formed as coaxial cylinders and said vessel being of cylindrical configuration and disposed between said elements coaxially therewith.

4. The generator defined in claim 1, further comprising internal baffles in said main vessel for slowing down the displacement for liquid therein.

5. A hot-fluid generator comprising:

at least two vertical catalyst elements having spacedly juxtaposed broad vertical surfaces for the combustion of a hydrocarbon fuel to generate heat;

a thin hollow vertical panel forming a main vessel and composed of heat-conductive walls interposed between and substantially coextensive with said surfaces;

a supply pipe below said vessel and communicating therewith for supplying a fluid to said vessel at the bottom thereof;

a distribution pipe above said vessel and communicating therewith for withdrawing heated fluid from said vessel, said fluid passing in a continuous sheet through said main vessel between said elements, said generator being of horizontal rectangular cross-section with said panel and said elements being planar and parallel to the same vertical plane; and a pair of planar vertical thin secondary vessels flanking said main vessel and lying along opposite vertical edges thereof while communicating with said main vessel, said secondary vessels lying in planes transverse to said catalyst elements.

6. The generator defined in claim 5, further comprising another pair of vertical planar catalyst elements perpendicular to the first mentioned catalyst elements and parallel to said secondary vessels.

7. A hot-fluid generator comprising:

at least two vertical catalyst elements having spacedly juxtaposed broad vertical surfaces for the combustion of a hydrocarbon fuel to generate heat;

a thin hollow vertical panel forming a main vessel and composed of heat-conductive walls interposed between and substantially coextensive with said surfaces;

a supply pipe below said vessel and communicating therewith for supplying a fluid to said vessel at the bottom thereof;

a distribution pipe above said vessel and communicating therewith for withdrawing heated fluid from said vessel, said fluid passing in a continuous sheet through said main vessel between said elements, said generator being of horizontal rectangular cross-section with said panel and said elements being planar and parallel to the same vertical plane; and a dome-shaped vessel lying above said main vessel and communicating therewith while overlying the space between said catalyst elements, said dome-shaped vessel having a downwardly concave wall formed with inwardly projecting fins.

8. The gnerator defined in claim 7 wherein said main vessel is formed with laterally projecting horizontal fins vertically spaced thereon.

9. The generator defined in claim 7, further comprising a further vessel lying transversely to said main vessel above the dome-shaped vessel and communicating with a source of fluid and with a conduit for discharging fluid.

10. The generator defined in claim 9 wherein said further vessel is provided with downwardly extending fins.

11. A hot-fluid generator comprising:

at least two vertical catalyst elements having spacedly juxtaposed broad vertical surfaces for the combustion of a hydrocarbon fuel to generate heat;

a thin hollow vertical panel forming a main vessel and composed of heat-conductive walls interposed between and substantially coextensive with said surfaces;

a supply pipe below said vessel and communicating therewith for supplying a fluid to said vessel at the bottom thereof;

a distribution pipe above said vessel and communicating therewith for withdrawing heated fluid from said vessel said fluid passing in a continuous sheet through said main vessel between said elements, said generator being of horizontal rectangular cross-section with said panel and said elements being planar and parallel to the same vertical plane; and a dome-shaped vessel lying above said main vessel and communicating therewith while overlying the space between said catalyst elements, said dome-shaped vessel is formed with at least one passage for venting exhaust gases from the space between said catalyst elements.

12. A hot-fluid generator comprising:

at least two vertical catalyst elements having spacedly juxtaposed broad vertical surfaces for the combustion of a hydrocarbon fuel to generate heat;

a thin hollow vertical panel forming a main vessel and composed of heat-conductive walls interposed between and substantially coextensive with said surfaces;

a supply pipe below said vessel and communicating therewith for supplying a fluid to said vessel at the bottom thereof;

a distribution pipe above vessel and communicating therewith for withdrawing heated fluid from said vessel, said fluid passing in a continuous sheet through said main vessel between said elements, said generator having a polygonal horizontal cross-section with outer catalyst elements arranged along the sides of a polygon, an inner catalyst element spacedly juxtaposed at each of said outer catalyst elements, said main vessel having the configuration of said polygon in horizontal cross-section.

13. A hot-fluid generator comprising:

at least two vertical catalyst elements having spacedly juxtaposed broad vertical surfaces for the combustion of a hydrocarbon fuel to generate heat;

a thin hollow vertical panel forming a main vessel and composed of heat-conductive walls interposed between and substantially coextensive with said surfaces;

a supply pipe below said vessel and communicating therewith for supplying a fluid to said vessel at the bottom thereof;

a distribution pipe above said vessel and communicating therewith for withdrawing heated fluid from said vessel, said fluid passing in a continuous sheet through said main vessel between said elements; and at least one thin secondary vessel in heat-conducting relationship with at least one of said catalyst elements along a side thereof opposite that of the catalyst element which confronts said main vessel.

* * * * *